United States Patent [19]

Adamski et al.

[11] 4,318,555

[45] Mar. 9, 1982

[54] STAPLER

[75] Inventors: Henry S. Adamski, Webster; John F. Hartman, Spencerport, both of N.Y.

[73] Assignee: Eastman Kodak Company, Rochester, N.Y.

[21] Appl. No.: 112,251

[22] Filed: Jan. 15, 1980

[51] Int. Cl.[3] ..... B27F 7/21

[52] U.S. Cl. ..... 283/7; 227/84; 227/88; 227/91; 227/78; 227/109

[58] Field of Search ..... 227/5, 7, 78, 84, 88, 227/91, 92, 94, 99, 109

[56] References Cited

U.S. PATENT DOCUMENTS

| | | | |
|---|---|---|---|
| Re. 7,014 | 3/1876 | McKay et al. | 227/109 |
| 978,297 | 12/1910 | Keith | 227/109 X |
| 1,410,694 | 3/1922 | MacKenzie | 227/75 |
| 1,450,164 | 4/1923 | Bates | 227/84 X |
| 3,069,938 | 12/1962 | Andrycha et al. | 227/109 |
| 4,220,275 | 9/1980 | Hametner et al. | 227/5 |

*Primary Examiner*—Paul A. Bell

*Attorney, Agent, or Firm*—William F. Noval

[57] ABSTRACT

A stapler for automatically driving staples of at least two different characteristics, such as length, into a workpiece. The stapler includes a staple driving member for driving staples into a workpiece, a staple forming member for forming staple blanks into staples and apparatus for selectively providing to the staple forming member staple blanks of at least first and second different lengths. Staple material of preselected first or second lengths is fed from a supply of a continuous length of staple material and severed from the continuous length to form the staple blanks.

12 Claims, 25 Drawing Figures

FIG. 2
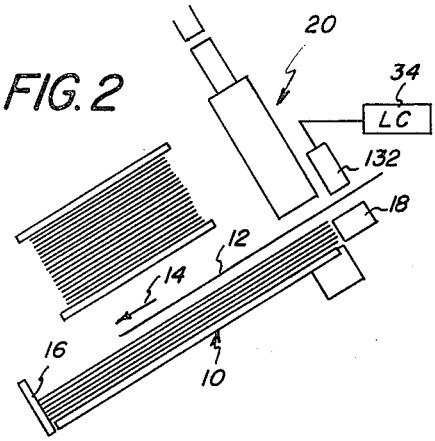
FIG. 9
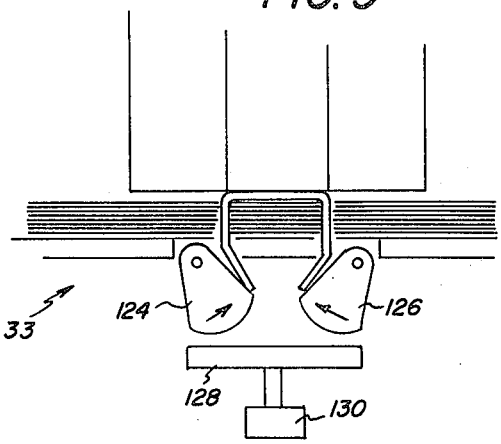
FIG. 10a
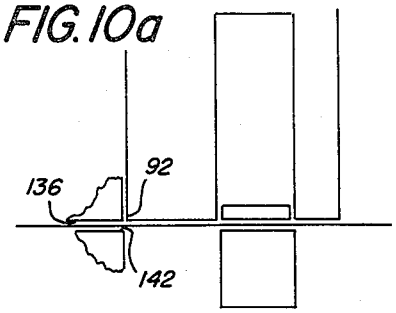
FIG. 11a
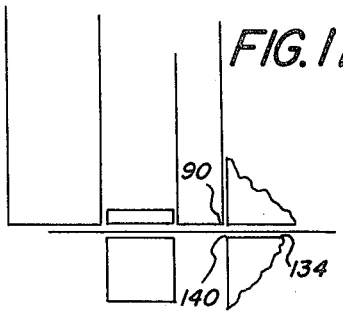
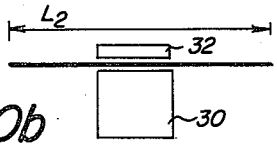
FIG. 10b
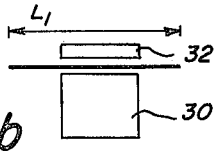
FIG. 11b
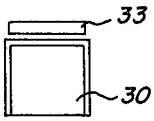
FIG. 10c
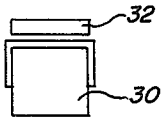
FIG. 11c
FIG. 10d
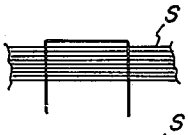
FIG. 11d
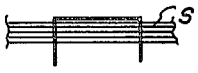
FIG. 10e
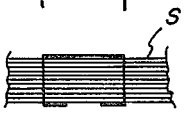
FIG. 11e
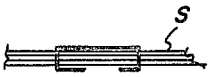

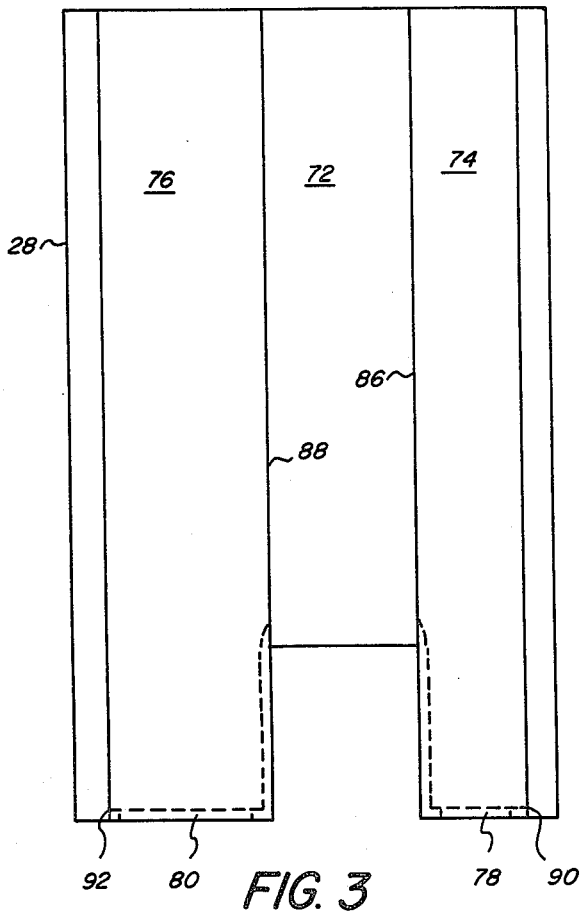
FIG. 3
FIG. 4b
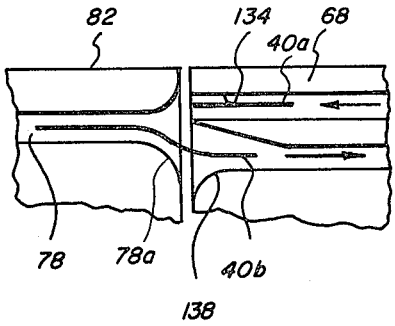
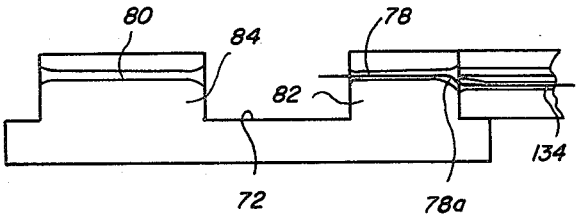
FIG. 4a
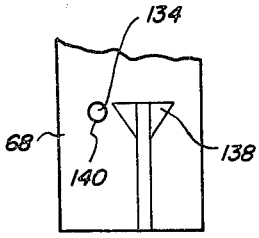
FIG. 5

FIG. 6a
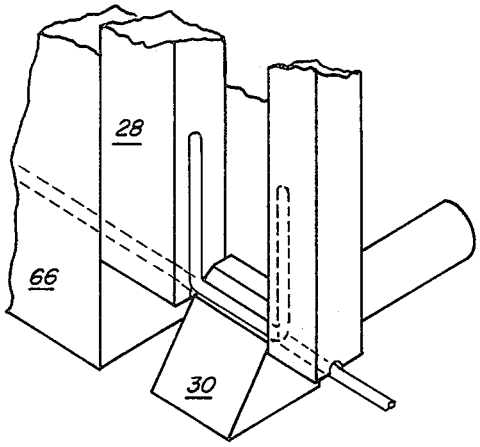
FIG. 7a
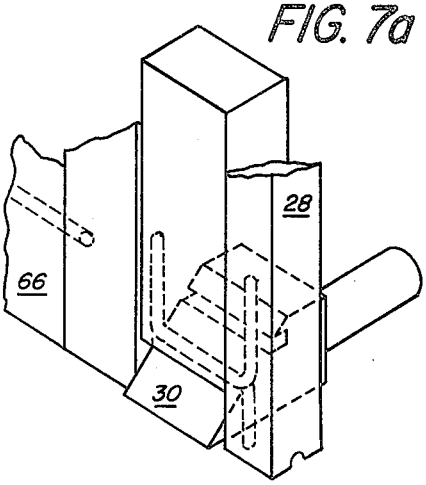
FIG. 6b
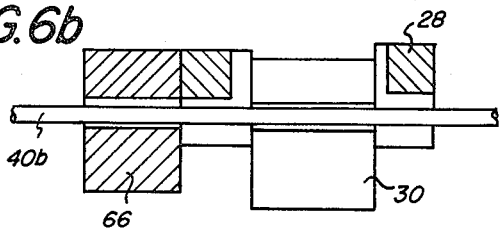
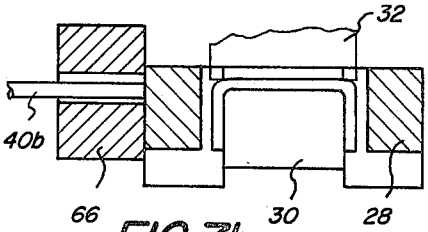
FIG. 7b
FIG. 8a
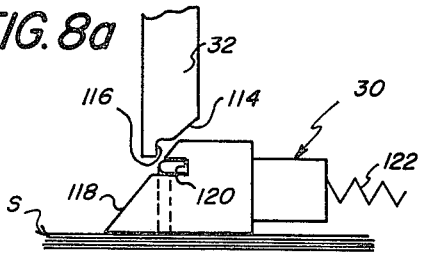
FIG. 8c
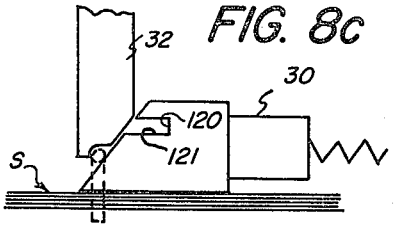
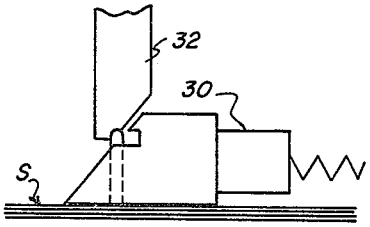
FIG. 8b
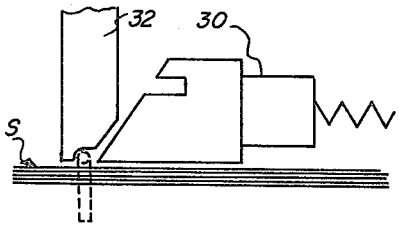
FIG. 8d

STAPLER

BACKGROUND OF THE INVENTION

This invention relates to staplers in general, and more particularly, to staplers for driving staples of different lengths into a workpiece.

With the ever increasing copy rate for reproduction machines such as copier duplicators, the need persists for equipment that can fasten together copy sets consisting of differing numbers of sheets quickly, efficiently and without interruption of the reproduction cycle. Copier/duplicator arrangements are known for producing sets of copies in precollated order, for assembling a set of copies into a stack and for stapling the copy set together into a booklet. The stapler in such case is generally capable of driving a staple of a single size which is used no matter how many sheets there are in a copy set. This limits the usefulness of the copier/duplicator where there is a wide range in the number of sheets in a set of originals to be reproduced. Thus, for example, if the stapler uses a staple which can fasten together 50 or less sheets of 20 lb. paper, sets having more than 50 sheets either cannot be stapled or will be poorly fastened together. Although use of a stapler using a larger staple would increase the number of sheets that could be fastened together, fastening of sets of a few sheets will result in undesirable overlapping of the staple ends.

In order to increase the capability of a stapler to handle sets of a wide range of number sheets without producing poorly fastened sets or heavily overlapped staples, a number of arrangements have been proposed to produce staples having different lengths. In staplers using preformed staples, the entire stapling mechanism must be changed manually to accommodate staples of different lengths. In staplers which form the staples from staple blanks cut from a continuous length of staple material, change of staple length is effected manually by changing one or more of the stapler components such as the staple material feeder, the position of the staple material severing mechanism or replacing the staple forming head. In any case, a manual changeover requires interruption of the stapling process which may result in interruption of the copier/duplicator process when the stapler is operating in synchronism therewith. Thus, copy output and efficiency is decreased and cost is increased.

SUMMARY OF THE INVENTION

According to the present invention there is provided apparatus for automatically stapling workpieces of different thicknesses. Thus, successive sets of sheets of widely different number of sheets may be stapled using staples of different lengths without the necessity of interrupting operation of the stapler for adjustment. As a result, the stapler of the present invention is highly efficient, cost effective, and capable of continuous operation at copier/duplicator copy output rate.

According to an aspect of the invention, a stapler is provided including means for forming a staple blank into a staple to be driven into the workpiece and means for providing staple blanks to said forming means of at least first and second predetermined characteristics, such as length.

Preferably a stapler according to the invention, includes a supply of a continuous length of staple material, means for selectively feeding at least one of first and second predetermined lengths of staple material from said supply and means for severing a fed length of staple material to produce a staple blank of the selected predetermined length. According to an aspect of the invention, the supply includes two supplies of continuous lengths of staple material and first and second means for feeding first and second predetermined lengths of staple material from said first and second supplies respectively.

The invention and its features and advantages will be set forth and become more apparent in the detailed description of the preferred embodiment presented below.

BRIEF DESCRIPTION OF THE DRAWINGS

In the detailed description of the preferred embodiment of the invention presented below, reference is made to the accompanying drawings, in which:

FIG. 2 is a diagrammatic elevation view of the stapler of FIG. 1 as used in cooperation with a sheet stacking tray;

FIG. 3 is a front elevational view of the forming member of the stapler of FIG. 1;

FIG. 4(*a*) is a bottom plan view of the member of FIG. 3 and including a portion of the bottom of a frame member;

FIG. 4(*b*) is an enlargement of the right hand area of FIG. 4(*a*);

FIG. 5 is a partial side elevation view showing the frame member of FIG. 4(*a*);

FIGS. 6(*a*) and 6(*b*) are respectively perspective and partially sectional elevation views of the cutting and forming member in cooperation with the anvil showing the staple forming and guiding channels;

FIGS. 7(*a*) and 7(*b*) are respectively perspective and partially sectional elevation views of the cutting and forming member, staple driving member and anvil illustrating forming of a staple;

FIGS. 8(*a*)–(*d*) are diagrammatic elevational views of the staple driving member and anvil illustrating continuous support of a staple during driving of a formed staple;

FIG. 9 is an elevational view showing the clinching mechanism clinching a staple driven through a set of sheets; and FIGS. 10(*a*)–(*e*) and 11(*a*)–(*e*) are diagrammatic views showing the feeding, cutting, forming, driving, and clinching operations for staples of first and second predetermined lengths $L_2$ and $L_1$ respectively.

DESCRIPTION OF THE PREFERRED EMBODIMENT

Figure 1:
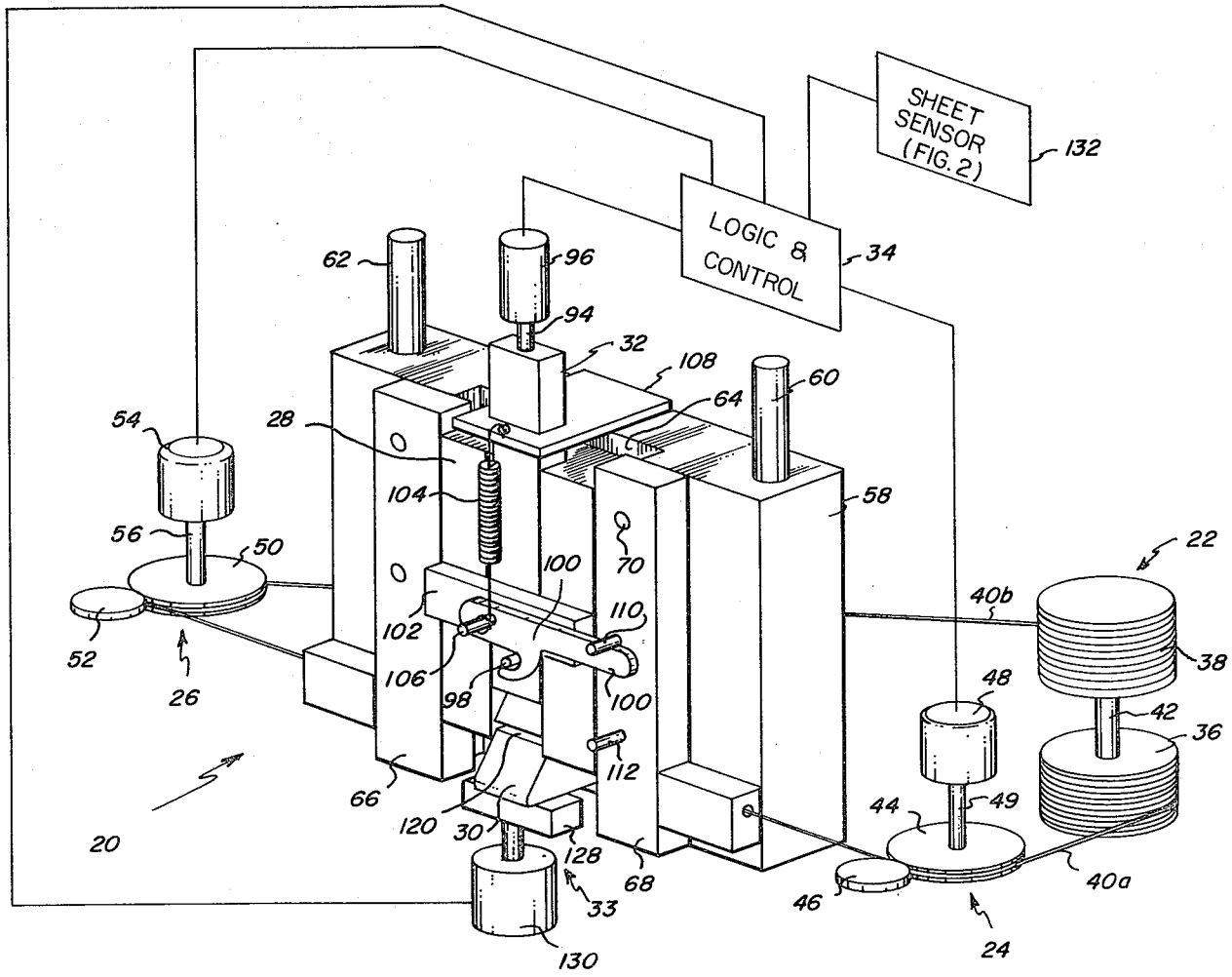
FIG. 1 is a schematic perspective view of a preferred embodiment of stapler according to the present invention.

In this application the term "workpiece" refers to any object or objects into which a staple may be driven. Thus, although the preferred embodiment is shown as stapling sets of sheets together with inwardly bent ends, the stapler may also be used to fasten any two or more materials together, as, for example, the fastening of flexible material to relatively solid material such as wood where the staple ends are driven into the wood without piercing it. The term "staple material" includes any material capable of being formed into a staple such as wire, flat metal, or the like. The term "characteristic" of the staple material is illustrated as being staple length, but may be any other characteristic. Thus, staples of different characteristics may be of different length, of different cross-sectional size or shape, of different material such as metal and plastic or the like.

Referring now to the figures, there is shown a preferred embodiment of stapler according to the present invention. Although the described stapler may be used for other purposes, it will be described herein in a preferred embodiment to staple together sets of copy sheets produced by a copier/duplicator. Such a use is illustrated in commonly assigned U.S. Pat. No. 4,134,672, issued Jan. 16, 1979, wherein a copy finisher is shown operating on-line with an electrographic copier/duplicator. The copier/duplicator produces a series of precollated copy sheets which are assembled by the copy finisher into a stacked set which may be stapled together to form a finished copy set. Referring to FIG. 2 there is shown tray 10, inclined to the horizontal, which receives copy sheets 12 in the direction shown by arrow 14 and aligns them in a stack against gate 16 by means of jogger 18. A stapler shown schematically as 20, staples the stacked sheets together and the stapled copy set is then transported out of tray 10 after gate 16 is lowered.

According to the present invention, a stapler is provided that is capable of stapling together copy sheets sets comprising a wide range of numbers of sheets without undesirable overlapping of the staple ends when a few sheets are stapled together and without poor fastening of sheets when a large number of sheets are stapled together. Referring now to FIG. 1 there is shown in greater detail a preferred embodiment of stapler according to the present invention.

In general, stapler 20 includes a supply 22 of staple material, staple material feed means 24 and 26, staple cutting and forming member 28, anvil 30, staple driving member 32, and staple clinching means 33. Logic and control means 34 is also provided to control the operation of stapler 20.

Supply 22 is shown as including spools 36 and 38 each supporting coiled continuous lengths of staple material such as wire 40(*a*) and 40(*b*). Spools 36, 38 are shown mounted for rotation on shaft 42 but may be mounted independently or by other means known in the art.

Feed means 24 and 26 draw wire 40(*a*), 40(*b*) from spools 36 and 38 respectively, and feed it in predetermined lengths $L_1$ and $L_2$ across anvil 30 (FIGS. 10 and 11). Means 24 includes a feed roller 44 about which wire 40(*a*) is partially wrapped, a roller 46 forming a nip with roller 44 and a drive motor 48 connected to roller 44 by shaft 49. Similarly, feed means 26 includes a feed roller 50 about which wire 40(*b*) is partially wrapped, roller 52 forming a nip with roller 50 and drive motor 54 connected to roller 50 by shaft 56. As will be explained in greater detail later, motors 48 and 54 are actuated by signals from logic and control 34 to rotate feed rollers 44 and 50 by incremental amounts to feed lengths of wire $L_1$ and $L_2$.

Staple cutting and forming member 28 is mounted for reciprocal movement in a frame 58 mounted for movement on rods 60 and 62. Member 28 is held within slot 64 of frame 58 by means of plates 66 and 68 screwed to frame 58 by screws 70. As shown more clearly in FIGS. 3 and 4, member 28 includes a centrally disposed slot 72 in which staple driving member 32 reciprocates, and staple forming portions 74 and 76, of different widths, having staple material guide slots 78, 80 respectively on the bottom faces 82, 84 thereof. Slots 78, 80 continue up the inner faces 86, 88 of forming portions 74, 76 and serve to support the wire during the forming operation as member 28 moves downwardly relative to anvil 30.

Member 28 is also provided with first and second cutting edges 90 and 92 for cutting predetermined lengths of wire 40 to form staple blanks. Edges 90 and 92 are spaced unequal distances from faces 86, 88, respectively. The cutting and forming functions of member 28 will be described in more detail later.

Staple driving member 32 is mounted for reciprocal movement in slot 72 of member 28 and is linked to and actuated by rod 94 of solenoid 96 which is controlled by logic and control 34. Member 32 is detachably linked to cutting and forming member 28 by means of a pin 98 mounted on member 32, and a link 100 hooked about pin 98 and pivotably mounted on bar 102 secured to member 28. Bar 102 also holds member 32 in slot 72 of member 28.

As seen in FIG. 1, members 28 and 32 are normally biased upwardly relative to frame 58 by means of tension spring 104 hooked at one end to pin 106 on link 100 and at the other end to plate 108 mounted on frame 58. Member 32 extends through an opening in plate 108. Pins 110 and 112 are provided on plate 68 to engage and disengage members 28 and 32.

Staple driving member 32 is provided with angled lower surface 114 (FIG. 8) having a slot 116 which is complementary to the wedged surface 118 of anvil 30 and slot 120 therein having staple material supporting surface 121. Anvil 30 is normally biased to a staple supporting position by spring 122.

Staple clinching means 33 (FIG. 9) includes pivotally mounted clinchers 124 and 126 actuated by pusher member 128 of solenoid 130.

The operation of stapler 20 for selectively driving staples of different characteristics, such as length, into a workpiece, such as a set of copy sheets, is as follows. For convenience, the operation of stapler 20 will be described with respect to the stapling together of a stacked set of copy sheets but it will be understood that stapler 20 may be used to fasten other types of material together.

As described above, precollated copies produced by a reproduction machine such as the copier/duplicator described in commonly assigned U.S. Pat. No. 4,134,672, are assembled in a tray 10 (FIG. 2). Stapler 20 receives a signal from logic and control 34 to feed either a first or a second length of staple material 40. This signal may be produced as a result of a sensor 132 which counts the number of sheets entering tray 10 and as a result of a preselected instruction stored in LC 34 actuates either feed means 24 or feed means 26.

More specifically, stapler 20 may be used to staple together sets of 20 lb. copy paper having 2 to 100 sheets in a set. In order to prevent undesirable overlapping of staple ends when only a few sheets are stapled or poor fastening when too many sheets are to be stapled together, stapler 20 selectively forms and drives staples of two different lengths. A staple of a first predetermined length is used to staple together sets having 2–50 sheets and a staple of a second predetermined longer length is used to staple together sets having 51–100 sheets. As described above, the selection of staple length may be preprogrammed into logic and control 34 and rendered automatically or an operator may enter an instruction into logic and control 34 by means of a switch which selects the proper length of staple. In either case, there is no manual adjustment of the stapler and thus no interruption of the copier/duplicator reproduction cycle.

After the proper staple length has been selected, control 34 sends an appropriate actuation signal to either staple material feed means 24 or 26. If a staple of first length is selected, a signal will be sent to motor 48 to rotate feed roller 44 so that a preselected length $L_1$ of wire 40*a* drawn from spool 36 is fed by rollers 44, 46 through feeding slot 134 in plate 68 (FIG. 5), through slot 78 in forming portion 74, across surface 121 of slot 120 in anvil 30 and through slot 80 in forming portion 76 such that the length $L_1$ is positioned on anvil 30 beneath forming member 28. The free end of wire 40*a* stops short of plate 66. If a staple of second length is selected, a signal will be sent by control 34 to motor 54 to rotate feed wheel 50 so that a preselected longer length $L_2$ of wire 40*b* drawn from spool 38 is fed by rollers 50 and 52 through feeding slot 136 in plate 66 (FIG. 10(*a*)), through slot 80 in forming portion 76, across surface 121 of slot 120 in anvil 30, through slot 78 in forming portion 74 and into receiving slot 138 in plate 68. Since the free end of wire 40*b* has a natural curvature from being coiled on spool 38, the far end of slot 78 has a widened portion 78*a* which permits the free end to curl away from slot 134 into funnel shaped slot 138. Thus, interference with wire 40*a* is prevented when wire 40*b* is fed.

After the selected staple length $L_1$ and $L_2$ has been fed across anvil 30, solenoid 96 is actuated by a signal from logic and control 34 to extend rod 94 and cause staple driving member 32 to be moved downwardly. Since member 32 is latched to forming member 28 which in turn is linked to frame 58 by means of spring 104, member 28 and frame 58 are carried down with member 32 until frame 58 and plates 66 and 68 secured thereto engage a stack of sheets which have been collected in tray 10 (FIG. 2). As member 32 continues to move downwardly, frame 58 is spring loaded against the sheet stack by spring 104 to prevent sheet slippage during the stapling operation.

Further downward movement of member 32 causes member 28 to sever either the length $L_1$ or the length $L_2$ of staple material 40 which has been fed across anvil 30. Where a length $L_1$ of material 40(*a*) has been fed, cutting edge 90 cooperates with the lower edge 140 of slot 134 (FIGS. 4) and 11(*a*)) to sever a staple blank of length $L_1$ from staple material 40(*a*) (FIG. 11(*b*)). Where a length $L_2$ of staple material 40(*b*) has been fed, cutting edge 92 cooperates with the lower edge 142 (FIG. 10(*a*)) of slot 136 to sever a staple blank of length $L_2$ from staple material 40(*b*), (FIG. 10(*b*)). FIGS. 6(*a*) and 6(*b*) illustrate the condition of wire 40(*b*) just prior to severing. Thus, it is seen that the different severed lengths $L_1$ or $L_2$ of wire 40 are effected by the different widths of portions 74 and 76 of member 28 and the resultant different distances of cutting edges 90, 92 from anvil 30.

As member 32 continues downwardly, it carries member 28 downwardly to shape staple blank of length $L_1$ or $L_2$ about anvil 30 to form a U-shaped staple. (FIGS. 10(*c*) and 11(*c*)). FIGS. 7(*a*) and 7(*b*) show the staple length $L_2$ formed into a staple ready for driving into a set of copy sheets. Since slot 138 is open at the bottom (FIG. 5), the right end of staple $L_2$ will clear member 68 and not be severed as member 28 descends.

Further descent of member 32 causes linkage 100 to engage pin 112 unlatching member 32 from member 28 which has bottomed on the copy sheet set S. Staple driving member 32 then drives the formed staple into set S. As illustrated in FIGS. 8(*a*)-8(*d*) during staple driving, the staple is continuously supported by anvil 30 as anvil is cammed out of the way through the engagement of angled face 114 of member 32 with the complementary angled face 118 of anvil 30. After the staple has been driven through sheet set S (FIGS. 10(*d*), 11(*d*)), a signal from LC 34 actuates solenoid 130 to cause clinchers 124, 126 to bend the ends of the driven staple inwardly against the bottom of set S (FIGS. 10(*e*) and 11(*e*)).

Solenoid arm 94 is now reversed to raise member 32 to its uppermost position. As member 32 is raised, the following is effected: Spring 122 causes anvil 30 to return to a position under member 32, linkage 100 engages pin 110 to latch it to pin 98 thereby latching members 28 and 32 together, the tension of spring 104 is relieved and frame 58 is lifted off the copy sheet set as members 28 and 32 move upwardly together. The stapled set S is then moved to an output receptacle to clear tray 10 for assembly of another set of copy sheets.

Logic and control 34 may take the form of the logic and control unit disclosed in commonly-assigned U.S. Pat. No. 4,134,672 at Column 7, line 3 et seq. The contents of this patent is hereby incorporated by reference.

As disclosed therein, the logic and control unit includes a computer which controls the operation of the copier and finisher including the stapler. The stored program control of the computer may be programmed to send out actuating signals to motors 48, 54 and solenoids 96 and 130 according to preselected conditions. For example, in the example given above, a length $L_1$ of staple material is fed if the number of sheets in a set is equal to 2 to 50 sheets and a length $L_2$ of staple material is fed if the number of sheets in a set is equal to 51 to 100 sheets. Sheet sensor 132 provides a count of the number of sheets entering the tray 10 to LC 34. If the computer should receive a feeder set count signal (see U.S. Pat. No. 4,134,672, Col. 9, line 42 et. seq.) and the count of sheets is 50 or less, then LD 34 will send a signal to motor 48 to feed a length $L_1$ of staple material 40(*a*). If the count is 51 or more when the feeder set count signal is received, then LC 34 will send a signal to motor 54 to feed a length $L_2$ of staple material 40(*b*).

After the staple material has been fed, a staple material fed signal from either motor 48 or 54 causes LC 34 to tend a signal to solenoid 96 to extend rod 94 and thereby drive member 32 downwardly. After the formed staple has been driven through the set S of sheets and solenoid rod 94 has been fully extended, a signal is sent by solenoid 96 to LC 34 which then sends a signal to solenoid 130 to actuate clinchers 124 and 126. After clinching is completed, LC 34 sends signals to solenoids 96 and 130 to return to their retracted positions.

It will be understood that drive means other than motors and solenoids may be used to actuate feed means 24 and 26, driving member 32 and clinching means 33. Thus fluid (e.g. pneumatic) actuated drive means may also be provided in lieu thereof.

The invention has been described in detail with particular reference to the preferred embodiment thereof, but it will be understood that variations and modifications can be effected within the spirit and scope of the invention.

What is claimed is:

1. Apparatus for producing staple blanks of different lengths, comprising:

means for supporting a staple blank;

means for supplying a continuous length of staple material;

means for selectively feeding either (1) a first predetermined length of staple material from said means for supplying to said means for supporting from a first direction; or (2) a second predetermined length of staple material from said means for supplying to said means for supporting from a second opposite direction;

first and second severing assemblies respectively spaced first and second distances from said means for supporting; and means for selectively actuating said means for feeding either (1) to feed said first length of staple material in cooperation with said first severing assembly to produce a staple blank of said first predetermined length or (2) to feed said second length of staple material in cooperation with said second severing means to produce a staple blank of said second predetermined length.

2. The apparatus of claim 1 including means cooperating with said means for supporting for forming a staple blank into a staple.

3. The apparatus of claim 2 wherein said means for forming cooperates with said first and second severing assemblies respectively to produce said staple blanks of said first and second predetermined lengths.

4. In a stapler including means for driving a formed staple into a workpiece, apparatus comprising:

means for forming a staple blank into a formed staple to be driven into a workpiece by said staple driving means, said means for forming including means for supporting a staple blank while it is formed into a staple and a reciprocating forming member cooperating with said supporting means for forming said staple blank into a staple about said supporting means; and means for selectively providing staple blanks to said forming means in at least first and second predetermined lengths, said means for providing including means for supplying a continuous length of staple material; means for selectively feeding one of said at least first and second predetermined lengths of staple material from said means for supplying; and means, associated with said means for forming, for severing a fed length of staple material into said staple blank, said means for severing including first and second severing assemblies cooperatively associated with said forming member spaced first and second different distances from said supporting means respectively.

5. The apparatus of claim 4 wherein said means for supplying includes separate supplies of continuous lengths of staple material respectively for said first and second predetermined lengths of material.

6. The apparatus of claim 4 wherein said means for supporting includes an anvil member and wherein said first and second severing assemblies include first and second severing edges on said forming member.

7. The stapler of claim 6 including first and second members having edges respectively cooperating with said first and second severing edges of said forming member to effect severing of said staple material to form said staple blanks.

8. A stapler for selective driving into a workpiece staples of different lengths, comprising:

means for supporting a staple;

supply means for supplying a continuous length of staple material;

means for selectively feeding from said supply means either a first predetermined length of staple material to said means for supporting from a first direction or a second predetermined length of staple material to said means for supporting from a second opposite direction;

a staple forming member;

means for mounting said staple forming member for reciprocal movement relative to said means for supporting in order to form a staple from a severed staple blank;

first and second severing means spaced different distances from said means for supporting cooperatively associated with said staple forming member for respectively severing staple blanks from said first and second predetermined lengths of staple material;

a staple driving member for driving a formed staple into a workpiece; and means for actuating said feed means to selectively feed one of said first or second predetermined lengths of staple material to said means for supporting, to cause said severing means to sever the selected length into a staple blank, to cause said forming member to form the staple blank into a formed staple about said means for supporting and to cause said driving member to drive the formed staple into a workpiece.

9. The stapler of claim 8 wherein said actuating means includes means for sensing the thickness of a workpiece, and wherein said feed means are selectively actuated in response to the thickness of the workpiece sensed by said sensing means.

10. The stapler of claim 8 wherein said first and second severing means include first and second severing edges on said forming member, said edges being spaced different distances from said means for supporting.

11. The stapler of claim 10 including first and second members having respective first and second channels through which said first and second lengths of staple material are fed, and wherein said channels have ends nearest said means for supporting including edges which cooperate with said first and second severing edges to cut the selected length of staple material into a staple blank.

12. Apparatus for producing formed staples comprising;

an anvil having a staple supporting surface;

a first member located on one side of said anvil spaced a first distance from said anvil and forming a first channel therebetween;

a second member located on the other side of said anvil spaced a second distance greater than said first distance from said anvil and forming a second channel therebetween;

said first member having a staple material feeding slot and an adjacent staple material receiving slot and said second member having a staple material feeding slot;

means for selectively feeding either (1) a first predetermined length of staple material from a continuous supply of such material, through said feeding slot of said first member and across said anvil supporting surface, said first length stopping short of said second member; or (2) a second predetermined length of staple material from said continuous supply of such material, through said feeding slot of said second member, across said anvil supporting surface and into the staple receiving slot of said first member;

means for actuating said feeding means to selectively feed one of said predetermined lengths of staple material; and staple severing and forming means having a first portion movable in said first channel and a second portion movable in said second channel for severing a fed length of staple material into a staple blank and for forming said staple blank about said anvil to produce a formed staple.

* * * * *